US006109449A

United States Patent [19]

Howk et al.

[11] Patent Number: 6,109,449

[45] Date of Patent: Aug. 29, 2000

[54] MIXING SYSTEM FOR SEPARATION OF MATERIALS BY FLOTATION

[75] Inventors: Richard A Howk, Pittsford; Michael A. Giralico, Rochester; Thomas A. Post, Pittsford, all of N.Y.

[73] Assignee: General Signal Corporation, Rochester, N.Y.

[21] Appl. No.: 09/185,673

[22] Filed: Nov. 4, 1998

[51] Int. Cl.[7] ..... B03D 1/16; B01F 3/04; B01F 7/22

[52] U.S. Cl. ..... 209/169; 261/93; 366/295

[58] Field of Search ..... 209/169; 261/93; 366/265, 295, 317

[56] References Cited

U.S. PATENT DOCUMENTS

| | | |
|---|---|---|
| 2,433,592 | 12/1947 | Booth . |
| 2,609,097 | 9/1952 | Dering . |
| 2,792,939 | 5/1957 | Myers . |
| 2,875,897 | 3/1959 | Booth . |
| 3,378,141 | 4/1968 | Warman . |
| 3,464,552 | 9/1969 | Warman . |
| 3,909,413 | 9/1975 | Nagahama . |
| 3,972,815 | 8/1976 | O'Cheskey . |
| 4,426,068 | 1/1984 | Gimond . |
| 4,454,077 | 6/1984 | Litz . |
| 4,611,790 | 9/1986 | Otsuka . |
| 4,800,017 | 1/1989 | Krishnaswamy . |
| 4,804,168 | 2/1989 | Otsuka . |
| 4,959,183 | 9/1990 | Jameson . |
| 5,009,816 | 4/1991 | Weise . |
| 5,039,400 | 8/1991 | Kallionen . |
| 5,116,488 | 5/1992 | Torregrossa . |

FOREIGN PATENT DOCUMENTS

| | | |
|---|---|---|
| 599848 | 4/1978 | U.S.S.R. . |
| 698240 | 10/1953 | United Kingdom . |

*Primary Examiner*—Thomas M. Lithgow
*Attorney, Agent, or Firm*—M. LuKacher; K. LuKacher

[57] ABSTRACT

A mixing system in a tank provides a flotation cell for froth collection of minerals such as metallic ores thereby separating such ores from other materials with which they are mined and enabling a concentrated ore component to be collected. The mixing system maintains particles containing the ores in a circulating liquid suspension in a contact zone where bubbles are discharged. Ore particles are attracted and attached to the bubbles. The bubbles rise and float to the top of the liquid for collection of the concentrated ores. The mixing system includes a radial flow impeller and an axial flow impeller which are attached for rotation on a common shaft, with the axial flow impeller below the radial flow impeller. The radial flow impeller is disposed in a space between a disc, which rotates with the radial flow impeller and another disc which is stationary, and may be a flange of a pipe around the shaft and extending above the surface of the liquid. Air or other suitable aeration medium is brought, either under pressure or by suction created by the radial flow impeller, into the space. The aeration medium is radially discharged in the form of bubbles. The axial flow impeller is downwardly pumping and provides a circulation path which sweeps across the bottom of the tank, then upwardly along the sides of the tank returning through the radial discharge of bubbles back into the inlet or suction side of the axial flow impeller. The circulation is limited to the contact zone. A quiet or quiescent zone above the contact zone is left through which the bubbles with attached ore particles can rise without bursting and form the froth containing the concentrated ore for collection.

22 Claims, 8 Drawing Sheets

MIXING SYSTEM FOR SEPARATION OF MATERIALS BY FLOTATION

DESCRIPTION

The present invention relates to mixing systems which are especially adapted for flotation separation of different species of materials, such as minerals as contained in ores, and particularly to a mixing system which minimizes power utilized to carry out flotation separation processes.

It is a principal feature of the invention to provide mixing apparatus which maintains a circulating solid suspension of the materials, disperses an aeration medium (air or a gas) into the circulating solid suspension, and mixes and blends the suspension with the air, while maintaining the circulation in a contact zone where the material to be separated attaches to bubbles of the aeration medium, which zone is separate from a quiet or quiescent zone through which the bubbles can rise and form a floating froth, reaching the surface without breaking and releasing the particles to be separated. The mixing apparatus is contained in a tank containing a liquid and particles of the material (ores and tailings with which the ores are mined); the liquid suitably being water containing additives which promote the hygroscopic attachment of particles of the materials to be separated by flotation are contained. The tank and mixing apparatus therein can be referred to as a flotation cell.

In order for flotation separation to be carried out effectively and efficiently, gas dispersion in the form of bubbles, solid suspension and mixing which blends the solid suspension and the bubbles, are all required. In addition, the region in the tank where circulation of the solid suspension occurs and there is contact between the bubbles of the aeration medium and the particles so that the species of material to be separated can adhere to the bubbles, called the contact zone, is desirably separated from a zone of the tank, above the contact zone, through which the bubbles can rise without breaking and releasing the particles which they carry (a quiet or quiescent zone). It is a feature of the invention to provide for suspension, dispersion of the aeration medium in the form of bubbles and blending and mixing, as well as separation into contact and quiet zones all with efficient use of operating power which runs the mixing apparatus, thereby reducing the power required to carry out the flotation separation process.

Flotation separation cells have included mixing mechanisms with various combinations of special impellers to obtain gas dispersion and blending, but have not achieved the efficiency of power utilization which is desired. For example, Booth, U.S. Pat. No. 2,875,897, issued Mar. 3, 1959, has used a special impeller by means of which gas is induced by induction. An axial flow impeller pumps upwardly and discharges flow directly into the gas inducing impeller. The arrangement militates against efficient power utilization as well as effective separation of contact and quiet zones. Special arrangements of baffles and draft tubes around the shaft, sometimes called crowders, have been used to separate the zones. See, for example, the Booth patent, Krishnaswany, et al., U.S. Pat. No. 4,800,017, Jan. 24, 1989 and Kallioinen, et al., U.S. Pat. No. 5,039,400, Aug. 13, 1991 and in the Wemco flotation machines advertised by Eimco Processing Equipment of Salt Lake City, Utah, U.S.

It is a principal object of the present invention to provide improved mixing apparatus which is effective in carrying out flotation separation of different material species with high efficiency, for example, reducing the power required in conventional flotation machines from 20 HP per Kgal or more, to 2 to 5 HP per Kgal.

It is another object of the present invention to provide improved flotation separation apparatus wherein solid suspension and circulation of the suspension is obtained with a down pumping axial flow impeller which sweeps the solids conglomerating at the bottom of the tank and circulates the solids past the gas bubble discharge from a radial flow impeller so as to maintain separate contact and quiescent zones in the tank, thereby enhancing and making efficient in terms of power consumption, the flotation separation process.

It is a still further object of the present invention to provide improved mixing apparatus which enhances the efficiency of flotation separation processes by utilizing a radial flow, gas dispersing impeller which operates efficiently by maintaining the impeller entirely or in substantial part in the gas which it disperses, thereby reducing the power requirement for gas dispersion in flotation separation processes.

It is a still further object of the present invention to provide improved mixing apparatus which provides circulation in a flotation separation tank or cell around a path downwardly through the gas as it is dispersed from another impeller, then across the bottom of the tank thereby precluding short circuiting of the bottom of the tank or of the circulation path across the dispersing gas, and thereby further enhancing the efficiency of the flotation separation process in terms of the required power to provide contact between the circulating materials and the dispersing bubbles of gas.

Briefly described, mixing apparatus for selective separation of different species of particulate materials by flotation, in accordance with the invention, makes use of means for providing a generally radially directed flow of bubbles of an aeration medium into a liquid medium in the tank. Other means are provided for circulation of a suspension of the materials along a generally downward path towards the bottom of the tank and across the radially directed flow of the aeration medium to define a contact zone below a quiescent zone in the tank, in which contact zone particles of the selected species of the materials hygroscopically attach to bubbles of the aeration medium and float with the bubbles into the quiescent zone for collection, when reaching the surface of the liquid medium in the tank.

The foregoing and other objects, features and advantages of the invention, as well as presently preferred embodiments thereof, will become more apparent from a reading of the following description in connection with the accompanying drawings which are briefly described below.

BRIEF DESCRIPTION OF DRAWINGS

Referring to FIGS. 1–5, there is shown a flotation cell provided by a tank 10. This tank contains a liquid medium, such as water. To this medium there may be added chemicals which promote hygroscopic attraction of metallic ores to be separated to bubbles which then rise to the top 12 or level of the liquid in the tank 10 where they float, forming a froth which is collected, for example, by flowing over an annular weir 14 into an annular collection tank 16. A skimmer for moving the froth towards the weir 14 may be used, but is not shown to simply the illustration. The floating bubble froth contains concentrated ore which is separated from other particles, sometimes called tailings, which can be drawn off the bottom 18 of the tank via outlet piping (not shown). The walls of the tank may have mounted thereon baffles 20. There may be four baffles spaced 90° apart. The top ends 22 of the baffles are disposed below the liquid level 12.

Figure 1:
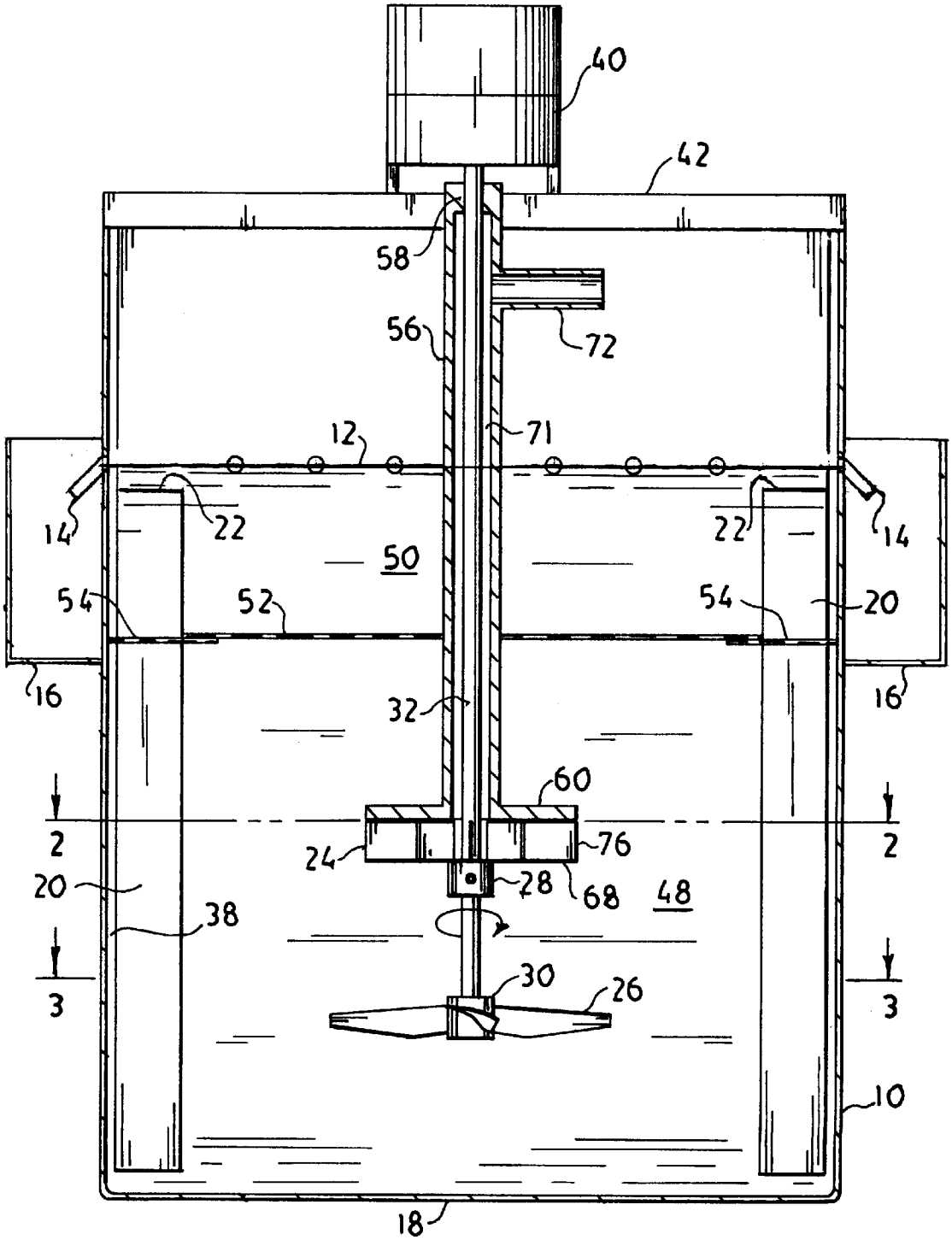
FIG. 1 is a schematic diagram of mixing apparatus provided by the invention in a flotation separation tank.
Figure 2:
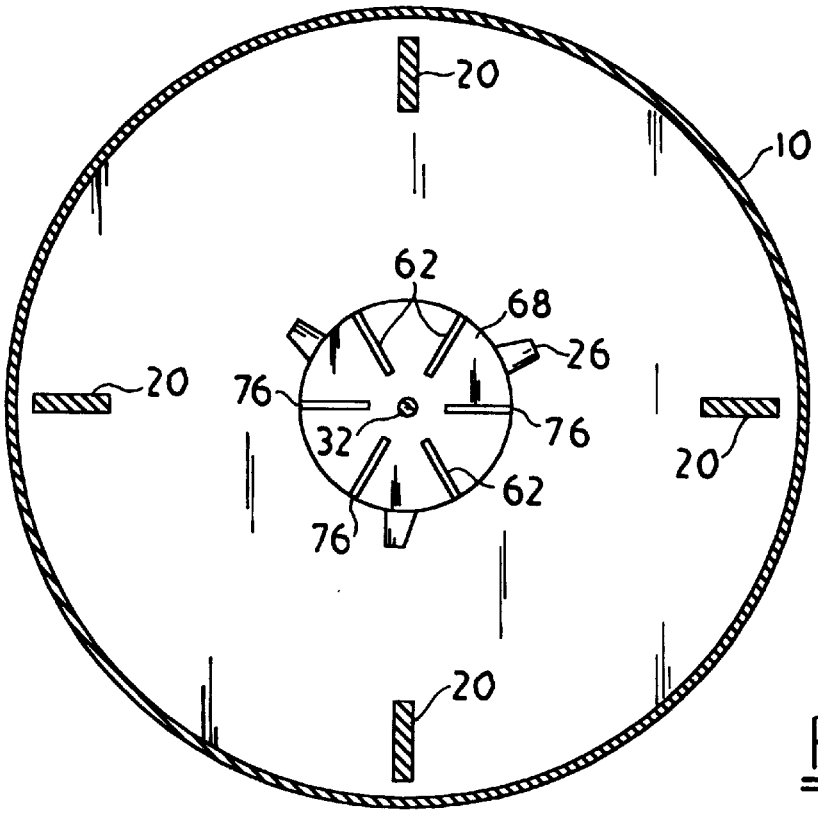
FIG. 2 is a plan view in section taken along the line 2—2 in FIG. 1.
Figure 3:
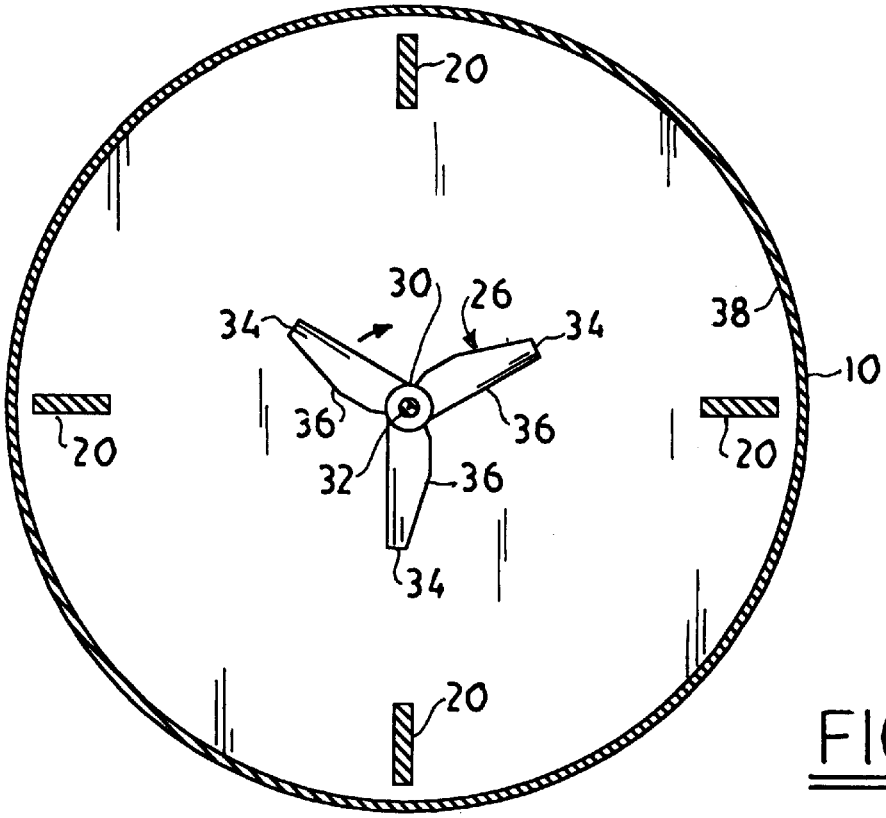
FIG. 3 is another plan view in section taken along the line 3—3 in FIG. 1.
Figure 4:
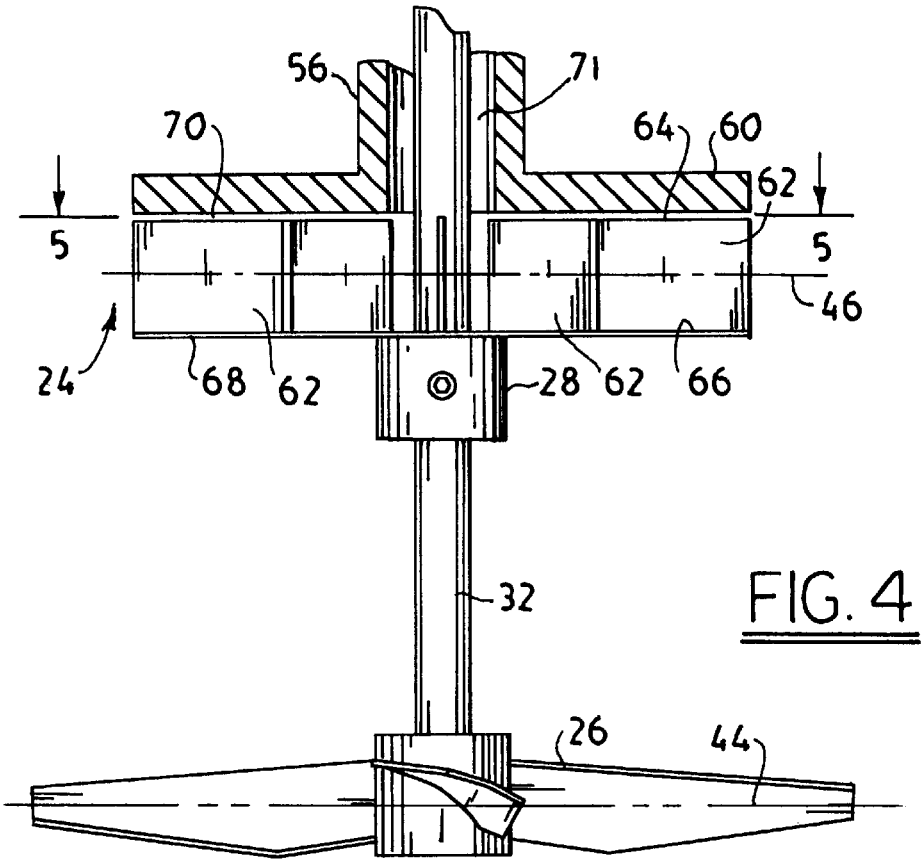
FIG. 4 is an enlarged view of the radial and axial flow impeller of the mixing apparatus shown in FIG. 1.
Figure 5:
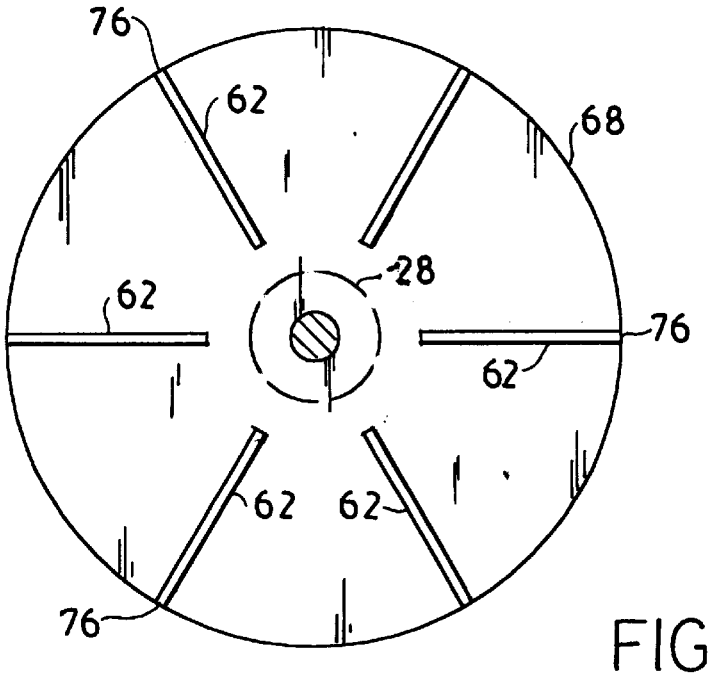
FIG. 5 is a plan view along the line 5—5 in FIG. 4.

The mixing apparatus utilizes a radial flow impeller 24 and an axial flow impeller 26. These impellers have hubs 28 and 30 which attach to a shaft 32 which rotates both impellers 26 and 24 about the same axis of rotation. The diameter of the axial flow impeller 26 as measured between the tips 34 of its blades 36, may be from 30 to 40 percent of the diameter of the tank as measured between the inside of the upright wall 38 of the tank.

The shaft 32 is driven by a drive mechanism 40 which may include a gearbox. This mechanism is supported on a crossbeam 42 over the top of the tank 10. The shaft extends towards the bottom 18 of the tank so that the axial flow impeller is disposed with its midline 44 from ⅜ D to 1 D (where D is the diameter of the impeller 26) away from the bottom 18 of the tank. This spacing is an example of the spacing sufficient to obtain circulation from the axial flow impeller when it pumps downwardly which sweeps across the bottom of the tank as will be explained more fully hereinafter in connection with FIG. 6. The radial flow impeller 24 is disposed so that its midline 46 is suitably D/2 from the midline 44 of the axial flow impeller 26. This D/2 spacing is an example of a spacing sufficient so that the circulation downwardly into the axial flow impeller 26 wraps around the discharge from the radial flow impeller. By crossing the discharge flow from the radial flow impeller, contact between the bubbles of air or other aeration medium discharging radially from the impeller 24 may be contacted with particles of the ore to be separated for the hygroscopic attachment of these particles to the bubbles. The bubbles then float through the contact zone 48 defined by the circulation or flow path from the axial flow impeller and rise through a quiet zone 50 above the contact zone to form the froth floating at the liquid level or surface 12. A perforated circular plate 52 which rests on a ring 54 is disposed in the quiescent zone. Perforations in the grid 54 allow the bubbles carrying the particles to be separated to pass therethrough while delineating the separation of the contact zone 48 from the quiescent zone 50.

Figure 12:
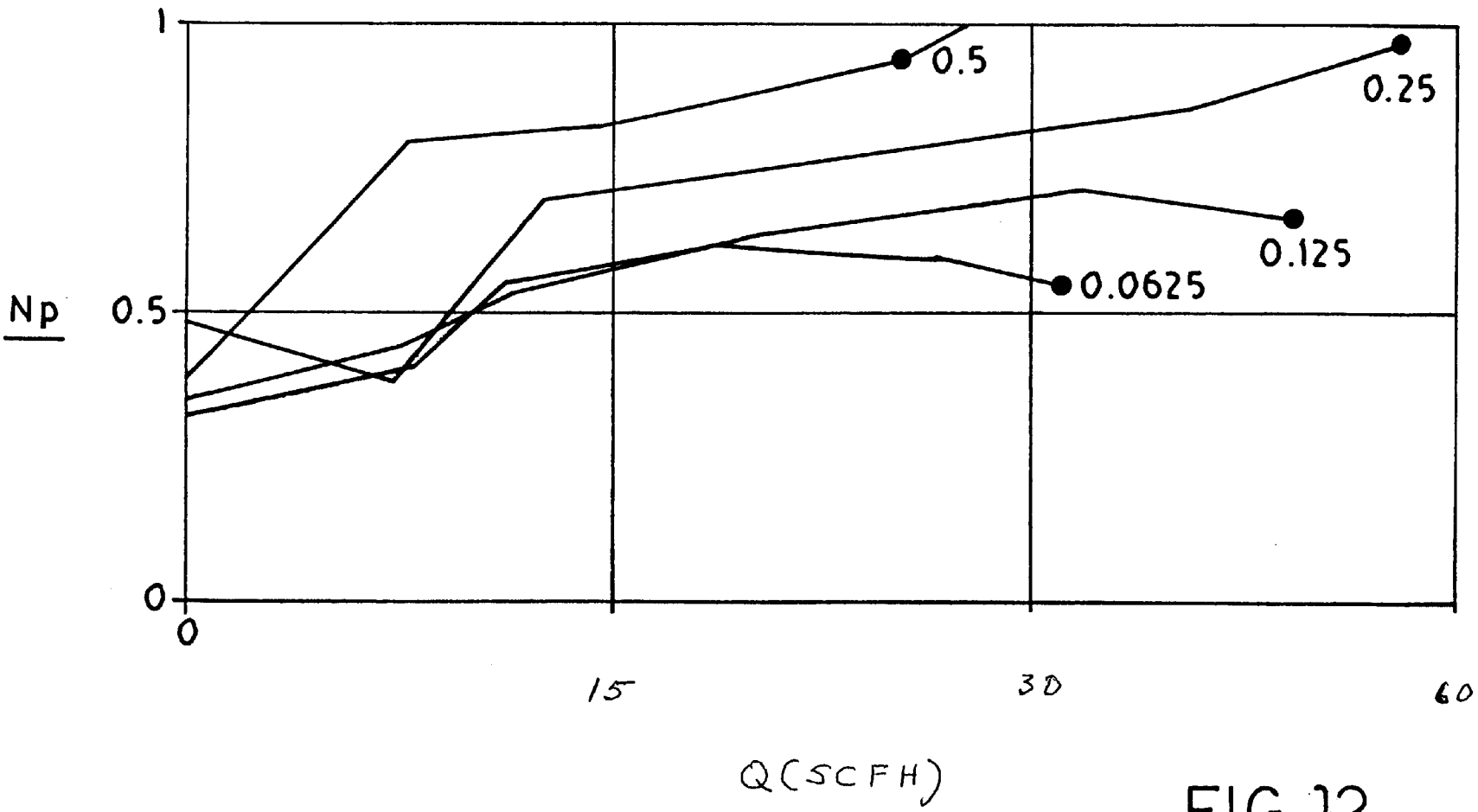
FIG. 12 is a plot illustrating the variation in power utilization in terms of power number, Np, as a function of flow in SCFH (cubic feet per hour flow at standard temperature and atmospheric pressure) for different spacings between the upper edge of the radial flow impeller shown in FIGS. 1–5 and the stationary flange of the air delivery pipe which, with the rotating disc along the lower edge of the impeller, defines a space for introduction of air and the discharge of air in the form of bubbles.

Around the shaft 32, is a hollow pipe 56 closed at the top 58 thereof and having a disc-shaped flange 60 at the bottom thereof. The pipe 56 and the flange 60 are fixed, as by being attached to the beam 42 or otherwise secured to the wall 38 of the tank 10. The radial flow impeller 24 has a plurality of flat plate blades 62. There are six blades 62, 60 degrees apart extending radially. These blades have upper and lower edges 64 and 66. The lower edges are attached to a disc 68. The diameter of the disc is equal to the diameter of the impeller 24. The diameter of the impeller 24 and the flange 60 are all approximately equal to each other. The upper edges 64 of the blades and the lower surface of the flange 60 are separated by a clearance gap 70. This gap in the embodiment shown in FIGS. 1 through 5 is just sufficient to provide clearance for rotation of the impeller 24 without interfering with the disc 60. The clearance may vary, for example, from 1/16 to ½ inch, depending upon the shearing mechanism which forms the bubbles which is desired, and also depending upon the power for rotating the impeller which is desired to be utilized. This relationship is illustrated in FIG. 12, for various power numbers and flow numbers, by a family of curves for gaps of varying size from 1/16 (0.0625) inch to ½ (0.5) inch. The impeller 26 D is about twenty inches for the data shown in FIG. 12.

The disc 68 which rotates with the impeller 24 and the fixed disc flange 60 define a space into which gas flows through the hollow interior 71 of the pipe 56. The gas may be pressurized gas (above the pressure at the head in the space between the flange 60 and the disc 68 below the liquid level 12 which is coupled via a side pipe 72). Gas may be introduced by induction due to the suction formed by the radial flow impeller 24. Then the side pipe 72 may be an open pipe. The gas flow may be throttled by a suitable valve in pipe 72 (not shown).

When the facing between flange 60, and the disc 68 is essentially sealed due to the minimum clearance in the gap 70, then the space between the flange 60 and the disc 66, which is essentially filled by the blades 62, contains essentially only air. This enhances the efficiency and is manifested by a lower power number Np as is illustrated in FIG. 12. Then bubbles are sheared mechanically at the intersection of the tips 76 of the radial blades and the liquid in the tank. It may be desirable to introduce fluid or hydraulic shear, in which event the spacing in the gap 70 is increased allowing some liquid into the space between the flange 60 and the disc 68. Liquid is then pumped radially with the gas. Due to the difference in flow rates of the liquid and the gas, hydraulic shearing of the gas into bubbles results which is in addition to the mechanical shearing at the tips 76. The tradeoff for using hydraulic shearing is additional power consumption as will be apparent from FIG. 12.

The radial flow impeller 24 may be of the type R300 available from Lightnin Mixers of 135 Mt. Read Blvd., Rochester, N.Y. 14611, USA. The R300 impeller includes the blades 62 and the disc 68 and hub 28. The arrangement of the R300 in inverted position to form the space thereby providing for enhanced power consumption in air handling is an important feature of the present invention.

The axial flow impeller which is illustrated by way of example in the drawings is the A310 impeller also available from Lightnin Mixers. This impeller is described in Weetman, U.S. Pat. No. 4,486,130, Aug. 23, 1984. Other axial flow impellers may be used. However, the A310 impeller is preferred because of its efficiency in terms of power consumption. The diameter as measured at the tips of the impeller 26 is larger than the diameter of the radial flow impeller 24. Preferably, the diameter of the impeller 26 is about 1.5 times the diameter of the radial flow impeller 24. This size relationship and the spacing between the axial and radial flow impellers is selected to provide the circulation path which defines the contact zone 48 and the separation of the zone 48 from the quiet zone 50.

Figure 6:
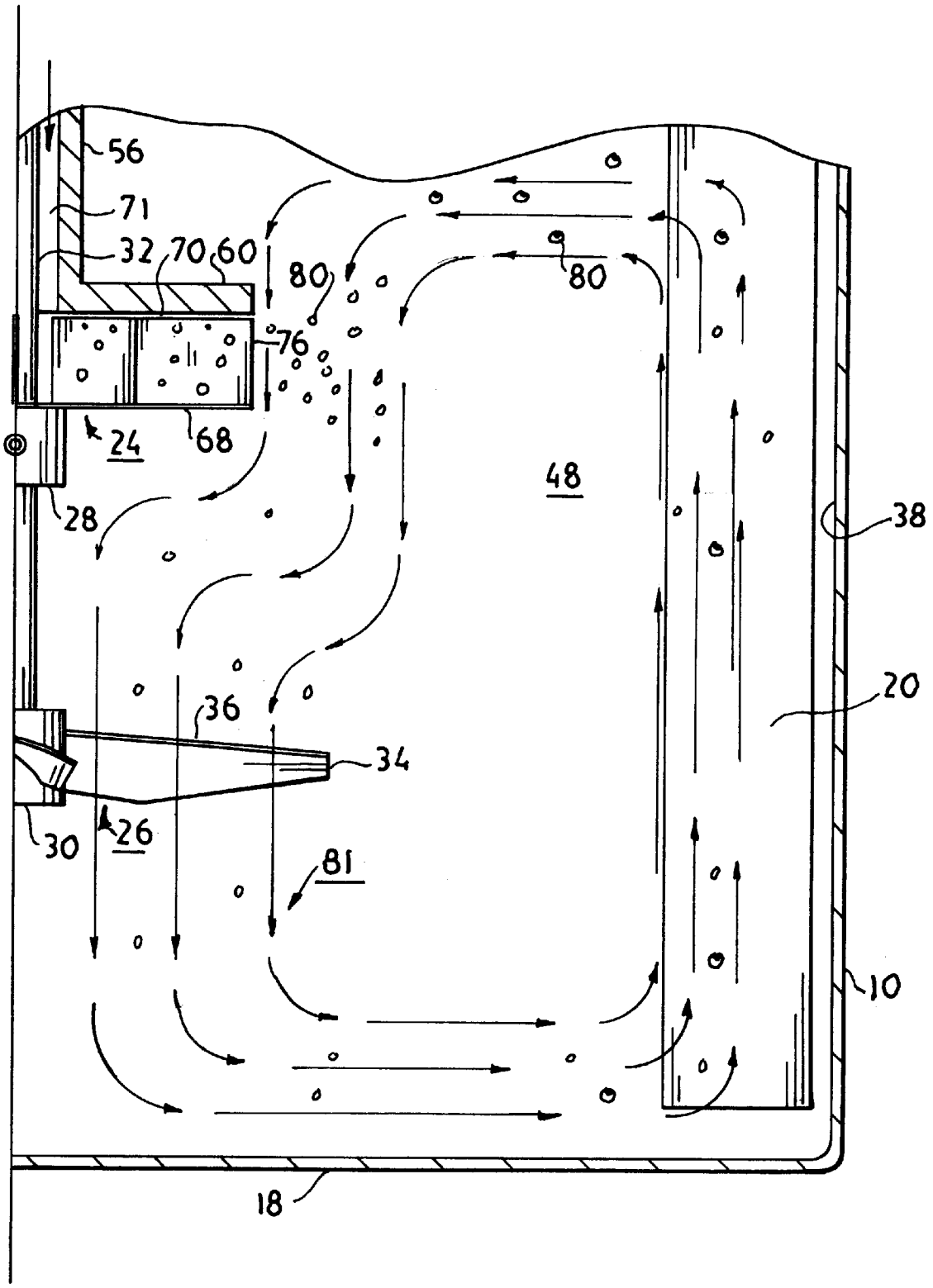
FIG. 6 is a schematic diagram illustrating the circulation and flow patterns obtained by the arrangement of impellers shown in FIGS. 1–5.

As shown in FIG. 6, the stream of bubbles of gas 80 expands as the stream is discharged radially from the radial flow impeller 24. The down pumping axial flow impeller 26 drives the flow downwardly towards the bottom 18 of the tank 10, where the flow sweeps up any particles collecting or conglomerating on the bottom 18. The flow then proceeds along the wall 38 of the tank directed by the baffles 20 and returns downwardly into the inlet side of the impeller. In other words, the pressure side of the impeller 26 faces downwardly while the suction side faces upwardly. The suction side then pulls the flow down through the impeller where it circulates around in the path 80. It will be appreciated that this path extends annularly around the tank 10. The path crosses the discharge stream of bubbles 80 as the discharge stream expands. As the flows cross and blend, the ore (selected species) particles carried with the flow are picked up with the bubbles. The bubbles adhere to the ore due to hygroscopic attraction. Some of the bubbles circulate around the path while others rise with attached particles through the quiet zone 50 up to the liquid level surface 12 where they collect as froth and can flow, for removal, over the weir 14 into the collection tank 16.

Figure 7:
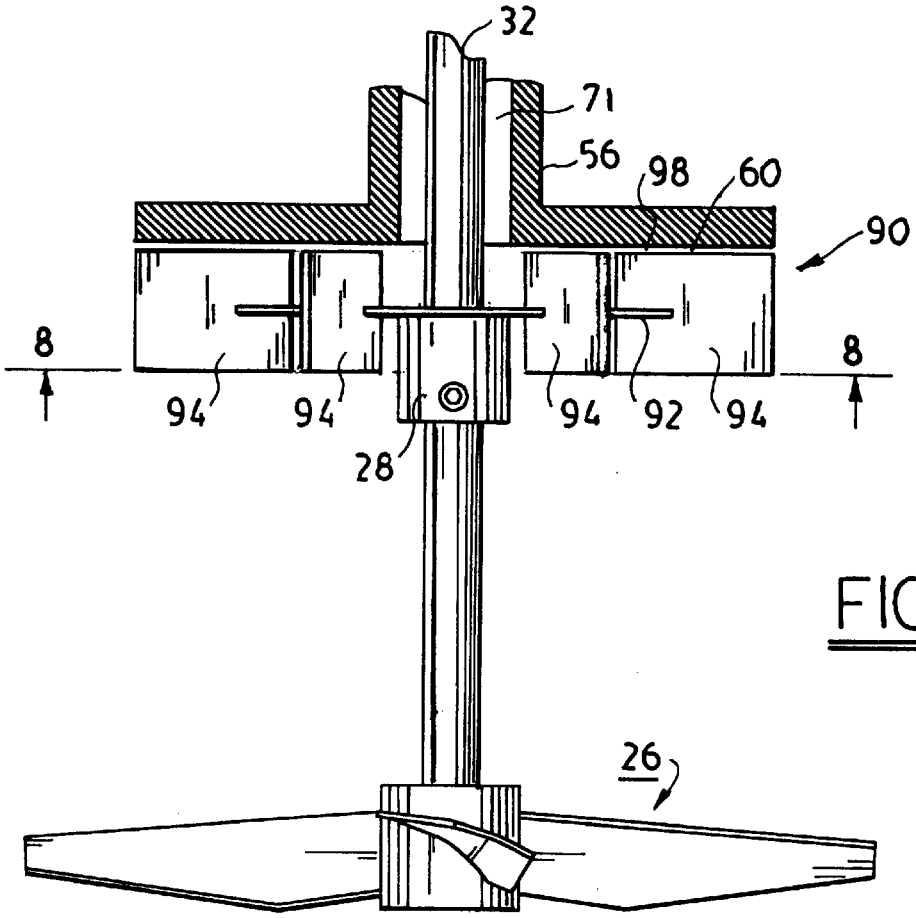
FIG. 7 is an elevational view similar to FIG. 4, illustrating mixing apparatus including a radial flow impeller of a type different from the impeller shown in FIGS. 1–5, in accordance with another embodiment of the invention.
Figure 8:
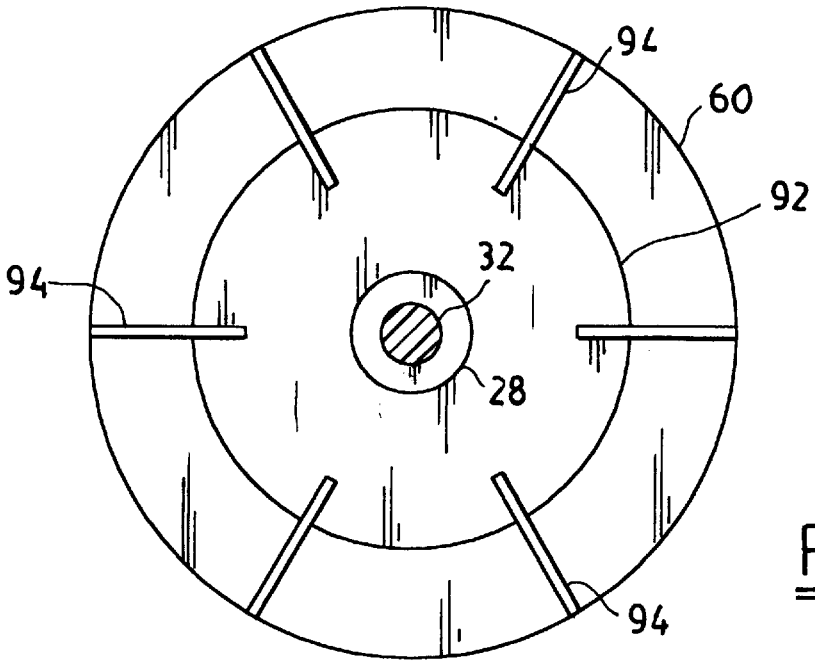
FIG. 8 is a sectional, plan view taken along the line 8—8 in FIG. 7.

Referring to FIGS. 7 and 8, the radial flow impeller 90 is of the R100 type, also available from Lightnin Mixers. This impeller has a central disc 92 to which the blades 94 are attached. This disc and the bottom surface of the flange 60 form the space into which the gas is introduced via the passage 71 in the hollow pipe 56. The upper edges 98 of the blades 94 are spaced from the bottom surface of the flange 60 just enough to provide a clearance gap which does not interfere with the rotation of the impeller 90. The impeller 94 does operate in the liquid in the tank and provides for hydraulic shear for forming bubbles. Preferably, the air is introduced into the space between the flange 60 and the disc 92 under pressure as from an external compressor. Otherwise, the mixing apparatus is similar to the apparatus described in connection with FIGS. 1 through 6.

Figure 9:
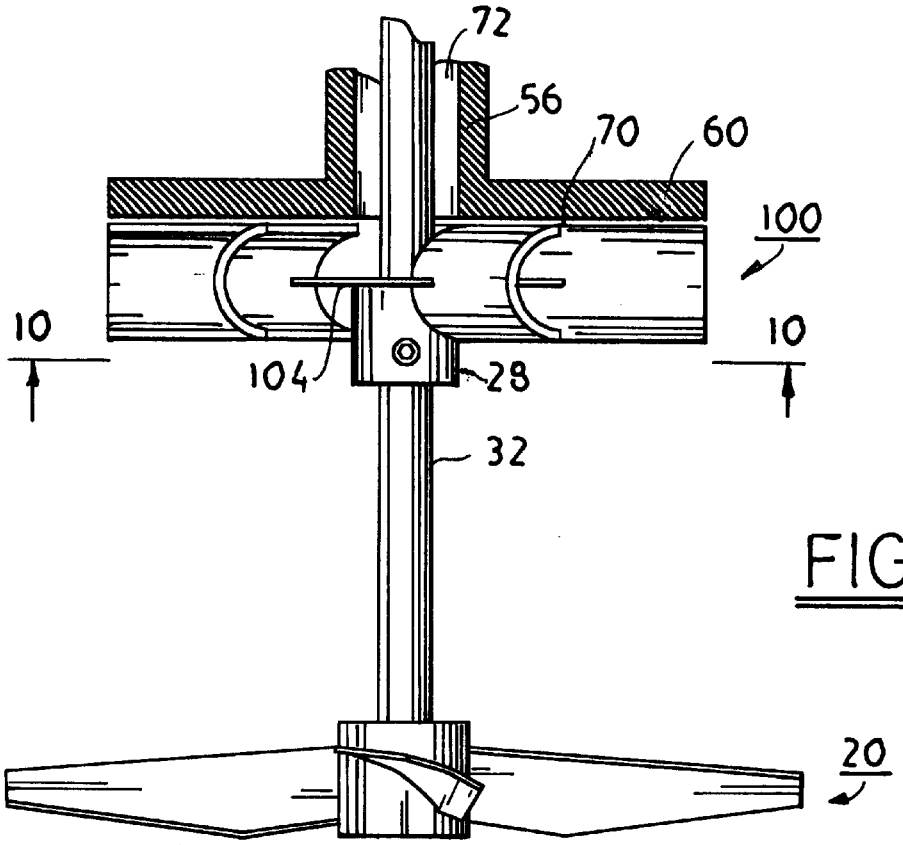
FIG. 9 is an elevational view similar to FIG. 4 showing a radial flow impeller of a type different from the impeller shown in FIGS. 4 and 7, and in accordance with still another embodiment of the invention.
Figure 10:
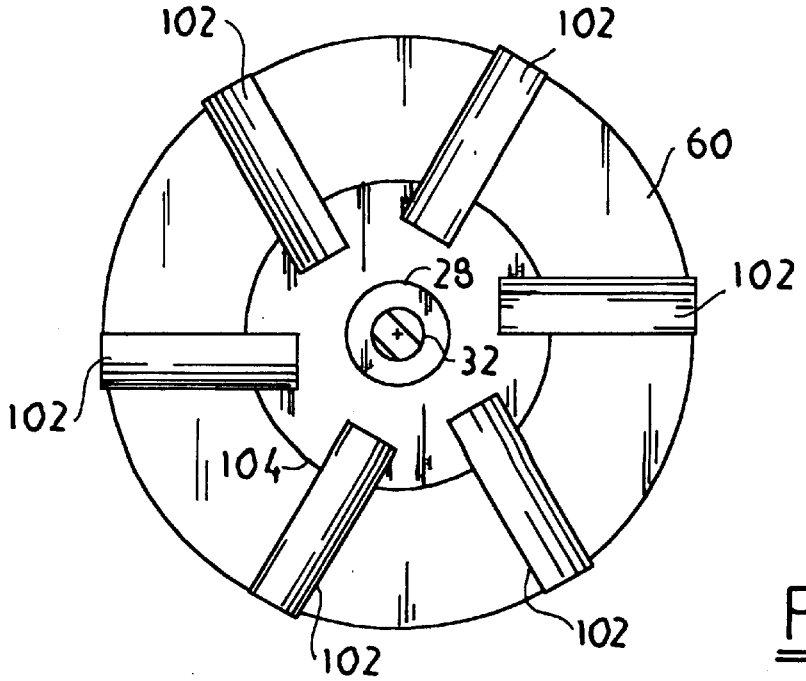
FIG. 10 is a sectional view taken along the line 10—10 in FIG. 9.

Referring to FIGS. 9 and 10 there is shown a radial flow impeller 100 which may be of the R130 type which is also available from Lightnin Mixers. This impeller includes 6 blades which are arcuate and form hemicylindrical cusps 102. The cusps 102 are tangent to radial lines extending from the axis of the shaft 32. The cusps 102 are attached to a central disc 104 which with the underside surface of the flange 60 provides a space into which the air is introduced via the hollow pipe 56. This air is preferably pressurized, as from an external compressor. The upper edges of the cusp blades 102 are spaced by the gap 70 from the flange 60 to provide a gap sufficient only for clearance for free rotation of the impeller 100. Gas is introduced into the space between the disc 104 and the flange 60 and is discharged radially outwardly. The cusp blades 102 also operate in liquid and provide for radial liquid pumping causing hydraulic shearing of the gas as well as mechanical shearing in order to obtain the discharge of bubbles. Otherwise, the operation of the mixing apparatus shown in FIGS. 9 and 10 is similar to the apparatus described in connection with FIGS. 1 through 6.

Figure 11:
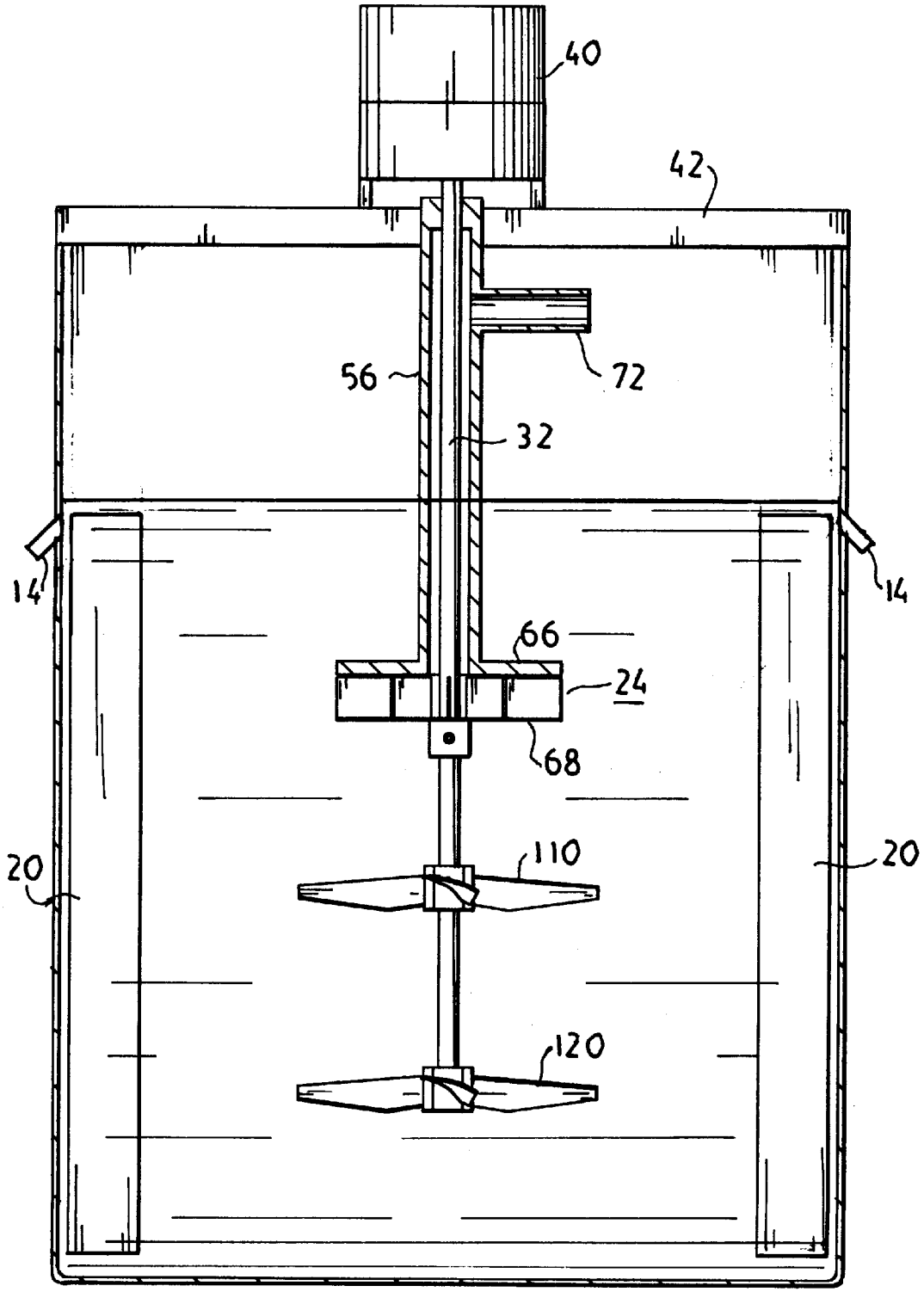
FIG. 11 is an elevational view similar to FIG. 1 showing an arrangement of two axial flow impellers on the same shaft as the radial flow impeller, in accordance with still another embodiment of the invention.

FIG. 11 illustrates a system where the radial flow impeller 24 may be located higher in the tank than is the case with the system shown in FIGS. 1 through 10. By placing the radial flow impeller higher in the tank, the hydraulic head at the depth of the radial flow impeller is less than in the case of the previously illustrated systems, thereby enhancing the flow of gas by suction due to the need to overcome a smaller pressure head in the space between the flange 60 and the disc 68.

In order to provide the circulation which sweeps across the bottom of the tank to pick up the particles and place them in suspension in the liquid in the tank, a pair of axial flow impellers 110 and 120, both of which may be of the A310 type, are mounted on the shaft 32. Both impellers are down pumping and increase the length in the vertical direction in the tank 10, of the circulation path. A quiet zone is still obtained, but that zone is shorter than the contact zone where circulation occurs.

From the foregoing description it will be apparent that there has been provided improved mixing apparatus and systems, especially suitable for use in flotation separation processes. Variations and modifications of the herein described mixing apparatus and the flotation mechanisms in which they are used will, of course, become apparent to those skilled in the art. Accordingly, the foregoing description should be taken as illustrative and not in a limiting sense.

What is claimed is:

1. Mixing apparatus for selective separation of different species of particulate materials by flotation which comprises means for providing a generally radially directed flow of bubbles of an aeration medium into a liquid in a tank, said tank having a wall extending from a top to a bottom thereof, means for providing circulation of a suspension of said materials along a generally downward path towards the bottom of the tank and across said radially directed flow, said circulation including said downward flow and a flow upwardly along said wall to define a contact zone below a quiescent zone in said tank in which said contact zone particles of selected species of said materials hydroscopically attach to said bubbles and flow with said bubbles into said quiescent zone for collection when reaching the surface of said liquid in said tank.

2. Mixing apparatus according to claim 1 wherein said radially directed flow providing means comprises a pair of plates defining a space with which an inlet for said aeration medium is in communication, one of said plates being a plate which is rotatably connected to blades of a radial flow impeller disposed in said space.

3. Mixing apparatus according to claim 2 wherein said one of said plates is a flange of a conduit through which said aeration medium flows into said space, which conduit is fixed with respect to said impeller.

4. Mixing apparatus according to claim 3 wherein said aeration medium is pressurized externally of said conduit to flow into said space or flows thereinto by suction created by said radial flow impeller.

5. Mixing apparatus according to claim 4 wherein said fixed flange is of a diameter approximately equal to the diameter of said impeller.

6. Mixing apparatus according to claim 2 wherein said radial flow impeller has a plurality of blades having upper edges spaced from lower edges thereof in a direction away from the bottom of the tank, the other of said plates being non-rotatable and spaced above said rotatable plate, said non-rotatable plate being sufficiently close to said rotatable plate to restrict the flow of the liquid medium into said space while said impeller is rotating while providing clearance from said upper edge of said radial flow impeller to allow rotation thereof.

7. Mixing apparatus according to claim 6 wherein the spacing of said non-rotatable plate from said upper edges is selected from close spacing which essentially excludes said liquid medium from said space to a spacing for allowing said liquid medium to enter into said space to be driven radially to impart hydraulic shearing of said aeration medium thereby assisting inflammation of said bubbles.

8. Mixing apparatus according to claim 7 wherein said rotatable plate is a disc co-axial with and of approximately the same diameter as said radial flow impeller and disposed along the lower edges of said impeller blades.

9. Mixing apparatus according to claim 7 wherein said rotatable plate is a disc co-axial with said axial flow impeller and disposed intermediates said upper and lower edges thereof, said upper edges of said impeller having clearance spacing from said non-rotational plate sufficient only to allow rotation thereof.

10. Mixing apparatus according to claim 9 wherein said disc is of a diameter less than the diameter of said radial flow impeller and of the non-rotational plate, and said blades extend radially beyond said rotational disc.

11. Mixing apparatus according to claim 9 wherein said blades are selected from the group consisting of a plurality of flat strips and a plurality of curved strips, said curved strips forming cusps defining surfaces extending generally tangentially to an access of rotation of said impeller.

12. Mixing apparatus according to claim 1 wherein said circulation providing means is at least one axial flow impeller operating for down pumping towards the bottom of the tank and with a spacing from about ⅜D to 1D from the bottom of the tank, where D is the diameter of the axial flow impeller.

13. Mixing apparatus according to claim 2 wherein said circulation providing means is at least one axial flow impeller operating for down pumping towards the bottom of the tank and with a spacing from about ⅜D to 1D from the bottom of the tank, where D is the diameter of the impeller, and said axial flow impeller being rotatable on the same shaft about the same axis as said radial flow impeller and spaced sufficiently close to said axial flow impeller to provide an inlet flow thereto which includes the discharge flow from said radial flow impeller and is not separated therefrom.

14. Mixing apparatus according to claim 13 wherein said diameter of said axial flow impeller is greater than the diameter of said radial flow impeller.

15. Mixing apparatus according to claim 14 wherein the diameter of said axial flow impeller is about 1.5 times the diameter of said radial flow impeller.

16. Mixing apparatus according to claim 13 wherein said axial flow impeller is spaced about ½D along said shaft away from said radial flow impeller wherein D is the diameter of said axial flow impeller.

17. Mixing apparatus according to claim 16 wherein said axial flow impeller is spaced about ½D along said shaft away from said radial flow impeller wherein D is the diameter of said axial flow impeller.

18. Mixing apparatus according to claim 12 wherein a plurality of said axial flow impellers are rotatable on a shaft and a lower one thereof has said spacing above the bottom of the tank.

19. Mixing apparatus for combining different fluid mediums which comprises means for providing a generally radially directed flow of a first fluid medium into a second fluid medium in a tank, said tank having a wall extending from a top to a bottom thereof, means for providing circulation of both said first and second fluid medium along a generally downward path towards the bottom of the tank and across said radially directed flow, said circulation including said downward flow and a flow upwardly along said wall to define a zone in said tank in which said fluid mediums are mixed.

20. Mixing apparatus according to claim 19 wherein said radially directed flow providing means comprises a pair of plates defining a space with which an inlet for said aeration medium is in communication, one of said plates being a plate which is rotatably connected to blades of a radial flow impeller disposed in said space.

21. Mixing apparatus according to claim 19 wherein said one of said plates is a flange of a conduit through which said first fluid medium flows into said space, which conduit is fixed with respect to said impeller.

22. Mixing apparatus according to claim 21 wherein said first medium is pressurized externally of said conduit to flow into said space or flows there into by suction created by said radial flow impeller.

* * * * *